US011795530B2

(12) United States Patent
Sieron et al.

(10) Patent No.: US 11,795,530 B2
(45) **Date of Patent: *Oct. 24, 2023**

(54) ELECTRICAL STEEL STRIP THAT CAN BE BUT DOESN'T HAVE TO BE REANNEALED

(71) Applicants: ThyssenKrupp Steel Europe AG, Duisburg (DE); thyssenkrupp AG, Essen (DE)

(72) Inventors: Sebastian Sieron, Essen (DE); Philipp Szary, Witten (DE); Olaf Fischer, Bochum (DE); Abdullah Kahveci, Bochum (DE); Karl Telger, Coesfeld (DE)

(73) Assignees: ThyssenKrupp Steel Europe AG, Duisburg (DE); thyssenkrupp AG, Essen (DE)

( * ) Notice: Subject to any disclaimer, the term of this patent is extended or adjusted under 35 U.S.C. 154(b) by 134 days.

This patent is subject to a terminal disclaimer.

(21) Appl. No.: 16/963,624

(22) PCT Filed: Jan. 23, 2019

(86) PCT No.: PCT/EP2019/051559

§ 371 (c)(1),
(2) Date: Jul. 21, 2020

(87) PCT Pub. No.: WO2019/149582

PCT Pub. Date: Aug. 8, 2019

(65) Prior Publication Data

US 2021/0062307 A1 Mar. 4, 2021

(30) Foreign Application Priority Data

Feb. 2, 2018 (DE) ..... 102018201618.6

(51) Int. Cl.

| | |
|---|---|
| ***C22C 38/14*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C22C 38/14* (2013.01); *C21D 8/0205* (2013.01); *C21D 8/0226* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01)

(58) Field of Classification Search

CPC .. C21D 8/0205; C21D 8/0226; C21D 8/0236; C21D 8/1233; C21D 8/1272; C21D 9/46; C22C 38/001; C22C 38/02; C22C 38/04; H01F 1/16

USPC ..... 420/103

See application file for complete search history.

(56) References Cited

U.S. PATENT DOCUMENTS

| | | | | |
|---|---|---|---|---|
| 6,139,650 | A * | 10/2000 | Oda | C22C 38/02 148/306 |
| 11,041,222 | B2 * | 6/2021 | Fischer | C22C 38/14 |
| 11,566,296 | B2 * | 1/2023 | Leunis | C22C 38/008 |
| 2014/0373340 | A1 | 12/2014 | Dorninger et al. | |
| 2015/0318093 | A1 | 11/2015 | Hill et al. | |
| 2017/0314087 | A1 * | 11/2017 | Leunis | C21D 8/1233 |
| 2020/0010918 | A1 | 1/2020 | Zaizen et al. | |
| 2021/0079493 | A1 * | 3/2021 | Sieron | C21D 6/008 |

FOREIGN PATENT DOCUMENTS

| | | | |
|---|---|---|---|
| CN | 1111295 | A | 11/1995 |
| CN | 1556869 | A | 12/2004 |
| CN | 102851577 | A * | 1/2013 |
| CN | 104141092 | A | 11/2014 |
| CN | 105779880 | A | 7/2016 |
| CN | 106119686 | A | 11/2016 |
| DE | 19681215 | | 4/1998 |
| EP | 0357800 | A1 | 3/1990 |
| EP | 2612942 | A1 | 7/2013 |
| EP | 2840157 | A1 | 2/2015 |
| JP | H11222653 | A | 8/1999 |
| JP | 2011162821 | A | 8/2011 |
| KR | 20160079470 | A | 7/2016 |
| WO | 9012130 | A2 | 10/1990 |
| WO | 0065103 | A2 | 11/2000 |

OTHER PUBLICATIONS

NPL: on-line translation of CN-102851577-A, Jan. 2013 (Year: 2013).*

Chinese Office Action for CN Application No. 201980011442.7 dated Jul. 20, 2021.

DIN EN 10351—Chemical analysis of ferrous materials—Inductively coupled plasma optical emission spectrometric analysis of unalloyed and low alloyed steels—Determination of Mn, P, Cu, Ni, Cr, Mo, V, Co, AL (total) and Sn [Routine method].

DIN EN 60404-13—Magnetic materials—Part 13: Methods of measurement of density, resistivity and stacking factor of electrical steel sheet and strip.

DIN EN 60404-2—Magnetic materials—Part 2: Methods of measurement of the magnetic properties of electrical steel strip and sheet by means of an Epstein frame.

(Continued)

*Primary Examiner* — Jie Yang

(74) *Attorney, Agent, or Firm* — RMCK Law Group PLC

(57) ABSTRACT

The invention relates to a non-grain-oriented electrical steel strip or sheet, in particular for electrical applications, an electrical component produced from such an electrical steel strip or sheet, a process for producing an electrical steel strip or sheet and the use of such an electrical steel strip or sheet in components for electrical applications.

15 Claims, No Drawings

(56) References Cited

OTHER PUBLICATIONS

DIN EN ISO 6892-1—Metallic materials—Tensile testing—Part 1: Method of test at room temperature.
German Office Action for DE Application No. 10 2018 201 618.6.
International Search Report for International Application No. PCT/EP2019/051559 dated Feb. 28, 2019 with English translation.

* cited by examiner

ELECTRICAL STEEL STRIP THAT CAN BE BUT DOESN'T HAVE TO BE REANNEALED

CROSS-REFERENCE TO RELATED APPLICATIONS

This application is a 371 U.S. National Stage of International Application No. PCT/EP2019/051559, filed Jan. 23, 2019. The disclosure of the above application is incorporated herein by reference in its entirety.

TECHNICAL FIELD

The invention relates to a non-grain-oriented electrical steel strip or sheet, in particular for electrical applications, an electrical component produced from such an electrical steel strip or sheet, a process for producing an electrical steel strip or sheet and the use of such an electrical steel strip or sheet in components for electrical applications.

Non-grain-oriented electrical steel strips or sheets, also referred to in technical language as "NO electrical steel strip or sheet" or in English as "NGO electrical steel" ("NGO"=non-grain-oriented), are used for reinforcing the magnetic flux in iron cores of rotating electric machines. Typical uses of such steel sheets are electric motors and generators, in these especially in the stator or in the rotor.

The non-grain-oriented electrical steel strips used in the stator and in the rotor of an electric machine, in particular of a motor or of a generator, preferably have different mechanical and magnetic properties. The rotor packet of an electric machine is preferably made of a material which has markedly improved mechanical properties, while the stator should have improved magnetic properties. The improvement in the magnetic properties in a material generally has an adverse effect on the mechanical properties of the material, and vice versa. For this reason, a material which represents a compromise between mechanical and magnetic properties is selected either for rotor or stator in the production of electric machines, or otherwise two different types of electrical steel strip have to be used for rotor and stator.

TECHNICAL BACKGROUND

EP 2 612 942 discloses a non-grain-oriented electrical steel strip or sheet composed of a steel which contains, apart from iron and unavoidable impurities, from 1.0 to 4.5% by weight of Si, up to 2.0% by weight of Al, up to 1.0% by weight of Mn, up to 0.01% by weight of C, up to 0.01% by weight of N, up to 0.012% by weight of S, from 0.1 to 0.5% by weight of Ti and from 0.1 to 0.3% by weight of P, where the ratio content of Ti/content of P, in each case in % by weight, is such that 1.0≤content of Ti/content of P≤2.0. The non-grain-oriented electrical steel strip or sheet and components for electrical applications made of such a sheet or strip display increased strengths and at the same time good magnetic properties. The NO electrical steel strip or sheet according to EP 2 612 942 is produced by cold rolling a hot-rolled strip consisting of a steel having the abovementioned composition to give a cold-rolled strip and subsequently subjecting this cold-rolled strip to a final heat treatment.

EP 2 840 157 discloses a non-grain-oriented electrical steel strip or sheet, in particular for electrical applications, produced from a steel which contains, apart from iron and unavoidable impurities, from 2.0 to 4.5% by weight of Si, from 0.03 to 0.3% by weight of Si, up to 2.0% by weight of Al, up to 1.0% by weight of Mn, up to 0.01% by weight of C, up to 0.01% by weight of N, up to 0.001% by weight of S and up to 0.015% by weight of P, with ternary Fe—Si—Zr precipitates being present in the microstructure of the electrical steel strip or sheet. EP 2 840 157 also discloses a process for producing such electrical steel strips and sheets, which process includes a final heat treatment.

WO 00/65103 A2 discloses a process for producing a non-grain-oriented electrical steel sheet, in which a steel precursor material containing less than 0.06% by weight of C, from 0.03 to 2.5% by weight of Si, less than 0.4% by weight of Al, from 0.05 to 1% by weight of Mn and less than 0.02% by weight of S is hot rolled to give a hot-rolled strip having a thickness of less than 3.5 mm, subsequently pickled and after pickling rolled to give a cold-rolled strip having a thickness of from 0.2 to 1 mm.

It is therefore an object of the invention to provide a non-grain-oriented electrical steel strip or sheet which can be used in electric machines, in particular electric motors or generators, both as rotor having improved mechanical properties and as stator having improved magnetic properties, with these different, mutually contradictory properties easily being able to be converted into one another.

This object is achieved by a non-grain-oriented electrical steel strip or sheet containing, apart from iron and unavoidable impurities (figures in each case in % by weight), up to 0.0040 of C, from 0.0700 to 0.3000 of Mn, from more than 2.700 to 3.250 of Si, from 0.5500 to 0.8500 of Al, up to 0.0400 of P, up to 0.0035 of S, up to 0.0070 of N and up to 0.0070 of Ti, where the ratio of magnetic loss $P_{1.0/50}$ in the finally heat treated state to the magnetic loss $P_{1.0/50}$ in the reference heat treated state is at least 1.10.

For the purposes of the present invention, "reference heat treatment" of the non-grain-oriented electrical steel strip of the invention is the heat treatment of the non-grain-oriented electrical steel strip or sheet according to the invention at the end of the production process, corresponding to the optional step (D) of the process described below, at a temperature of from 600 to 1000° C. The "reference heat treated state" is thus a state of the non-grain-oriented electrical steel strip or sheet according to the invention after heat treatment at a temperature of from 600 to 1000° C. Correspondingly, the "finally heat treated state" is a state of the non-grain-oriented electrical steel strip according to the invention before the heat treatment at a temperature of from 600 to 1000° C., corresponding to the optional step (D) of the process of the invention.

The objects are additionally achieved by a process for producing the non-grain-oriented electrical steel strip or sheet of the invention, by a component for electrical applications produced from such an electrical steel strip and by the use of the electrical steel strip in components for electrical applications.

The non-grain-oriented electrical steel strip of the invention is made of a steel which contains, apart from iron and unavoidable impurities, (figures in each case in % by weight)

up to 0.0040 of C,
from 0.0700 to 0.3000 of Mn,
from more than 2.700 to 3.250 of Si,
from 0.5500 to 0.8500 of Al,
up to 0.0400 of P,
up to 0.0035 of S,
up to 0.0070 of N and
up to 0.0070 of Ti.

The non-grain-oriented electrical steel strip of the invention is preferably produced from a steel containing, apart from iron and unavoidable impurities, (figures in each case in % by weight)

from 0.001 to 0.004 of C,
from 0.14 to 0.17 of Mn,
from more than 2.7 to 3.25 of Si,
from 0.6 to 0.75 of Al,
up to 0.030% by weight, more preferably at least 0.005% by weight, of P,
from 0.0005 to 0.002 of S,
from 0.001 to 0.002 of N and
from 0.002 to 0.004 of Ti.

The amounts of the individual elements present in the steel which is preferably used according to the invention are determined by methods known to a person skilled in the art, for example by chemical analysis in accordance with DIN EN 10351: 2011-05 "Chemical analysis of ferrous materials—inductively coupled plasma optical emission spectrometric analysis of unalloyed and low alloyed steels".

The inventors of the present invention have discovered that it is possible to provide a non-grain-oriented electrical steel strip which can be used in electric machines, in particular electric motors and generators, both as stator having good magnetic properties and as rotor having good mechanical properties, wherein the change in the properties is effected by means of a reference heat treatment of the material obtained after the final heat treatment. According to the invention, the reference heat treatment makes it possible to obtain a non-grain-oriented electrical steel strip which has improved magnetic properties compared to the finally heat treated material; in particular, the magnetic losses P at various polarizations and/or frequencies are significantly reduced. This property of the material of the invention is expressed by the ratio of magnetic loss $P_{1.0/50}$ in the finally heat treated state to magnetic loss $P_{1.0/50}$ in the reference heat treated state being at least 1.10, i.e. by the magnetic loss $P_{1.0/50}$ in the reference heat treated state being significantly reduced. Otherwise, the grain-oriented electrical steel strip of the invention in the non-heat treated state has improved mechanical properties compared to the reference heat treated state, which is revealed, for example, by the ratios of the yield points and tensile strengths in the finally heat treated and reference heat treated state being greater than 1.

According to the invention, the non-grain-oriented electrical steel strip or sheet of the invention has good mechanical properties in the finally heat treated state and good magnetic properties in the reference heat treated state. In this way, a significant efficiency increase of electric machines is achieved using the non-grain-oriented electrical steel strip of the invention compared to a uniform material for rotor and stator, since it is possible to provide for each of rotor and stator a material which has either improved mechanical properties or improved magnetic properties.

In a preferred embodiment, the present invention provides the non-grain-oriented electrical steel strip or sheet according to the invention which in the reference heat treated state has very small, specific grain sizes, for example a grain size here of from 50 to 130 μm, preferably from 70 to 100 μm. The present invention therefore preferably provides the non-grain-oriented electrical steel strip according to the invention which in the reference heat treated state has a grain size of from 50 to 130 μm, preferably from 70 to 100 μm. The grain size can be determined by all methods known to a person skilled in the art, for example by a microstructural analysis by means of optical microscopy in accordance with ASTM E112 "Standard Test Methods for Determining Average Grain Size".

The non-grain-oriented electrical steel strip or sheet of the invention has an advantageous ratio of magnetic losses P in the finally heat treated state to magnetic losses P in the reference heat treated state. According to the invention, the "finally heat treated" state including a skin pass (rolling step) can also be referred to as a "semifinished" state. For the purposes of the present invention, $P_{1.0/50}$ refers to the magnetic loss P at a polarization of 1.0 T and a frequency of 50 Hz. The magnetic losses P can be determined for the purposes of the invention by means of, for example, an Epstein frame, in particular in accordance with DIN EN 60404-2:2009-01: Magnetic material—Part 2: Methods of measurement of the magnetic properties of electrical steel strip and sheet by means of an Epstein frame". Here, appropriate electrical steel sheets are measured in the longitudinal direction (L), transverse direction (Q) or in a combination of the two (mixed direction (M)). For the purposes of the present invention, the values for the mixed direction (M) are reported in each case.

In the non-grain-oriented electrical steel strip or sheet of the invention, the ratio of magnetic loss $P_{1.0/50}$ in the finally heat treated state to magnetic loss $P_{1.0/50}$ in the reference heat treated state is at least 1.10, preferably at least 1.40. An upper limit for this ratio is, for example, 3.0.

In the non-grain-oriented electrical steel strip or sheet of the invention, the ratio of magnetic loss $P_{1.5/50}$ in the finally heat treated state to magnetic loss $P_{1.5/50}$ in the reference heat treated state is preferably at least 1.05, particularly preferably at least 1.20, very particularly preferably at least 1.40. An upper limit for this ratio is, for example, 2.0.

More preferably, the ratio of magnetic loss $P_{1.0/400}$ in the finally heat treated state to magnetic loss $P_{1.0/400}$ in the reference heat treated state in the non-grain-oriented electrical steel strip or sheet of the invention is at least 1.05, particularly preferably at least 1.20, very particularly preferably at least 1.30. An upper limit for this ratio is, for example, 1.80.

These ratios according to the invention of the magnetic losses at various polarizations and/or frequencies clearly show that the magnetic properties in the non-grain-oriented electrical steel strip or sheet of the invention are significantly improved by the reference heat treatment.

In the non-grain-oriented electrical steel strip or sheet of the invention, the ratio of yield point Rp0.2 in the finally heat treated state to yield point Rp0.2 in the reference heat treated state is preferably at least 1.05, particularly preferably at least 1.10, very particularly preferably at least 1.15. An upper limit for this ratio is, for example, 1.40.

The ratio of tensile strength Rm in the finally heat treated state to tensile strength Rm in the reference heat treated state in the non-grain-oriented electrical steel strip or sheet of the invention is preferably at least 1.03, particularly preferably at least 1.05. An upper limit for this ratio is, for example, 1.20.

In the non-grain-oriented electrical steel strip or sheet of the invention, the ratio of polarization $J_{2500/50}$ in the finally heat treated state to polarization $J_{2500/50}$ in the reference heat treated state is preferably at least 1.01. For the purposes of the present invention, $J_{2500/50}$ refers to the polarization at a field strength of 2500 A/m and a frequency of 50 Hz. Methods for determining polarization and field strength are known to a person skilled in the art, for example by means of an Epstein frame for determining the polarization, in particular in accordance with DIN EN 60404-2:2009-01:

Magnetic materials—Part 2: Methods of measurement of the magnetic properties of electrical steel strip and sheet by means of an Epstein frame".

Compared to grain-oriented electrical steel strips according to the prior art, the non-grain-oriented electrical steel strip or sheet of the invention has an advantageous, relatively high specific electrical resistance. Methods for determining the specific electrical resistance are known per se to a person skilled in the art, for example with the aid of a four-point measurement in accordance with DIN EN 60404-13: 2008-05 "Magnetic materials—Part 13: Methods of measurement of density, resistivity and stacking factor of electrical steel sheet and strip".

In general, the non-grain-oriented electrical steel strip or sheet of the invention can be present in all thicknesses which are suitable for electrical applications. According to the invention, the electrical steel strip or sheet preferably has particularly low thicknesses since the magnetic losses are lower at these low thicknesses than at greater thicknesses. The electrical steel strip or sheet of the invention preferably has a thickness of from 0.26 to 0.38 mm, in each case with a deviation of up to 8%.

The non-grain-oriented electrical steel strip or sheet of the invention preferably has a yield point Rp0.2 of from 400 to 580 N/mm$^2$, with the non-grain-oriented electrical strip or sheet of the invention preferably having a yield point Rp0.2 of from 480 to 560 N/mm$^2$ in the finally heat treated state and a yield point Rp0.2 of from 400 to 500 N/mm$^2$ in the reference heat treated state. The yield point is, for the purposes of the invention, determined by methods known to a person skilled in the art, for example the tensile test in accordance with DIN EN ISO 6892-1: 2017-02 "Metallic materials—Tensile test—Part 1: Method of test at room temperature".

The non-grain-oriented electrical steel strip or sheet of the invention preferably has a tensile strength Rm of from 500 to 680 N/mm$^2$, with the non-grain-oriented electrical steel strip or sheet of the invention preferably having a tensile strength Rm of from 580 to 640 N/mm$^2$ in the finally heat treated state and preferably a tensile strength Rm of from 500 to 580 N/mm$^2$ in the reference heat treated state. Testing is carried out in the longitudinal direction of the material, i.e. in the rolling direction of the electrical steel strip, which is generally the poorer direction for tensile strength because of possible anisotropy present in the material. The tensile strength is, according to the invention, determined by methods known to a person skilled in the art, for example the tensile test in accordance with DIN EN ISO 6892-1: 2017-02 "Metallic materials—Tensile testing—Part 1: Method of test at room temperature".

The non-grain-oriented electrical steel strip of the invention is characterized in that it has particularly advantageous mechanical properties in the finally heat treated state and can be converted by heat treatment into a material which has particularly advantageous magnetic properties. This material can thus be used in electric machines, in particular electric motors or generators, both as stator and also as rotor, which in turn gives the abovementioned advantages.

The present invention also provides a process for producing a non-grain-oriented electrical steel strip or sheet according to the invention, which comprises at least the following process steps:

(A) Provision of a hot-rolled strip containing, apart from iron and unavoidable impurities, (figures in each case in % by weight)

up to 0.0040 of C,
from 0.0700 to 0.3000 of Mn,
from more than 2.700 to 3.250 of Si,
from 0.5500 to 0.8500 of Al,
up to 0.0400 of P,
up to 0.0035 of S,
up to 0.0070 of N and
up to 0.0070 of Ti, (B) Cold rolling of the hot-rolled strip to give a non-grain-oriented electrical steel strip and (C) Heat treatment of the cold-rolled strip from step (B) to give a non-grain-oriented electrical steel strip.

For this purpose, a hot-rolled strip having the composition indicated above for the non-grain-oriented electrical steel strip or sheet of the invention is firstly provided, and this is subsequently cold rolled and subjected as cold-rolled strip to a heat treatment (step (C), also referred to as final heat treatment). Step (C) of the process of the invention results in a non-grain-oriented electrical steel strip which is ready for use in electric machines and displays a stress-free state combined with above-average good mechanical properties compared to types of non-grain-oriented electrical steel strip according to the prior art. Due to the fine grain microstructure which is likewise achieved, possible damage caused by a parting process such as cutting, stamping or laser cutting is less than in the case of types of non-grain-oriented electrical steel strip according to the prior art.

According to the invention, the non-grain-oriented electrical steel strip obtained after step (C) of the process of the invention can be subjected to a further heat treatment step (D), referred to as the "reference heat treatment". In this, any damage arising at the parting edges in the parting process is repaired and grain growth is promoted in the core of the material. This results in the material which has been treated in this way having excellent magnetic properties.

The present invention therefore preferably provides the process of the invention, wherein the following step (D):

(D) Reference heat treatment of the non-grain-oriented electrical steel strip from step (C) at a temperature of from 600 to 1000° C.

is carried out after step (C).

The individual steps of the process of the invention are described in detail below.

Step (A) of the process of the invention comprises provision of a hot-rolled strip containing, apart from iron and unavoidable impurities, (figures in each case in % by weight) up to 0.0040 of C, from 0.0700 to 0.3000 of Mn, from more than 2.700 to 3.250 of Si, from 0.5500 to 0.8500 of Al, up to 0.0400 of P, up to 0.0035 of S, up to 0.0070 of N and up to 0.0070 of Ti. Preferred amounts are indicated further above.

The production of the hot-rolled strip provided according to the invention can be carried out largely conventionally. For this purpose, a steel melt having a composition corresponding to that prescribed by the invention can firstly be melted and cast to give a precursor material, which in the case of conventional manufacture can be a slab or thin slab.

The precursor material produced in this way can subsequently be brought to a precursor material temperature of from 1020 to 1300° C. For this purpose, the precursor material is reheated if necessary or maintained at the respective target temperature by utilization of the heat of casting.

The precursor material which has been heated in this way can be hot rolled to give a hot-rolled strip having a thickness which is typically from 1.5 to 4 mm, in particular from 1.5 to 3 mm. Hot rolling commences in a manner known per se at an initial hot rolling temperature in the finishing train of greater than 900° C., for example from 1000 to 1150° C., and ends with a final hot rolling temperature of less than 900° C., for example from 700 to 920° C., in particular from 780 to 850° C.

The hot-rolled strip obtained can subsequently be cooled to a reel temperature and reeled up to give a coil. The reel temperature is ideally selected so that problems are avoided in the cold rolling subsequently carried out. In practice, the reel temperature is for this purpose not more than, for example, 700° C.

After hot rolling or before cold rolling, a heat treatment can optionally be carried out in the reeled-up state. This heat treatment step is carried out at, for example, a temperature of from 600 to 900° C.

A cleaning step by means of pickling can optionally be carried out before the cold rolling in step (B) of the process of the invention. Appropriate methods are known per se to a person skilled in the art.

Step (B) of the process of the invention comprises cold rolling of the hot-rolled strip to give a cold-rolled strip.

The hot-rolled strip provided is cold rolled to give a cold-rolled strip having a thickness which typically corresponds to the thickness of the electrical steel strip or sheet of the invention, i.e. preferably from 0.26 to 0.38 mm, in each case with a deviation of up to 8%. Processes and procedures for cold rolling are known per se to a person skilled in the art. According to the invention, the decrease in thickness of the material in the first pass is preferably not more than 35%. Furthermore, the decrease in the thickness of the material in the last pass is preferably not more than 20%.

Step (C) of the process of the invention comprises heat treatment of the cold-rolled strip from step (B) in order to give a non-grain-oriented electrical steel strip.

Step (C) of the process of the invention is preferably carried out as a continuous process. Appropriate apparatuses, i.e. furnaces, in which the cold-rolled strip from step (B) of the process of the invention can be continuously heat treated are known per se to a person skilled in the art. The heat treatment in step (C) of the process of the invention is preferably carried out at a temperature of from 750 to 1000° C., particularly preferably from 750 to 950° C. The process speed at the temperature indicated is preferably from 60 to 100 m/min.

After the heat treatment carried out in step (C) of the process of the invention, the non-grain-oriented electrical steel strip obtained is preferably cooled to ambient temperature and can, if desired, be coated on the surface with a surface coating. Appropriate processes and surface coatings are known per se to a person skilled in the art. The non-grain-oriented electrical steel strip or sheet obtained after step (C) can advantageously be used in electric machines.

The present invention preferably provides the process of the invention, wherein the following step (D):

(D) reference heat treatment of the non-grain-oriented electrical steel strip from step (C) at a temperature of from 600 to 1000° C. is carried out after step (C).

Step (D) of the process of the invention ("reference heat treatment") is carried out when an electrical steel strip or sheet according to the invention which has particularly advantageous magnetic properties and can again preferably be used as stator in an electric machine is to be obtained. Step (D) of the process of the invention is preferably carried out on components which have been parted from the non-grain-oriented electrical steel strip which is obtained in step (C). Parts which are to be used as stator in electric machines are preferably separated by stamping or cutting from the non-grain-oriented electrical steel strip obtained in step (C). Methods for doing this are known per se to a person skilled in the art, for example stamping, laser beam cutting, waterjet cutting, wire erosion. The optional step (D) of the process of the invention can, according to the invention, be carried out on the components themselves, it is also possible according to the invention for the individual components to be assembled to give packets and then treated in step (D).

The optional step (D) of the process of the invention comprises heat treatment at a temperature of from 600 to 1000° C., preferably from 700 to 900° C., particularly preferably from 750 to 850° C. According to the invention, the temperatures mentioned can fluctuate by up to 20° C. upward and by up to 15° C. downward during step (C).

In the optional step (D) of the process of the invention, the heating rate is preferably at least 100° C./h. The hold time at the final temperature in this step is, according to the invention, preferably at least 20 min.

In general, the optional step (D) can be carried out in all ways known to a person skilled in the art. According to the invention, step (D) is preferably carried out in a static furnace plant. It is likewise possible to carry out step (D) in a continuous heat treatment process, which is known per se to a person skilled in the art.

The present invention also provides a component for electrical applications, produced from an electrical steel strip or sheet according to the invention, preferably having a theoretical density of from 7.55 to 7.67 kg/cm$^3$. Examples of components for electrical applications are electric motors, generators or transformers, in particular rotors or stators which preferably represent basic components of an electric machine by means of which energy conversion can be carried out, in particular electric energy into mechanical energy or mechanical energy into electric energy.

The present invention further provides for the use of an electrical steel strip or sheet according to the invention in components for electrical applications, in particular in electric motors, generators or transformers, in particular rotors or stators, which preferably represent basic components of an electric machine by means of which energy conversion can be carried out, in particular electric energy into mechanical energy or mechanical energy into electric energy.

EXAMPLES

The invention will be illustrated in more detail below with the aid of working examples.

Silicon steels having the compositions shown in table 1 are used as base material.

TABLE 1

| | Sample 1 | Sample 2 | Sample 3 |
|---|---|---|---|
| C | 0.0011 | 0.0016 | 0.002 |
| Mn | 0.155 | 0.152 | 0.158 |
| P | 0.01 | 0.011 | 0.013 |
| S | 0.0012 | 0.0006 | 0.0005 |
| Si | 3.11 | 3.11 | 3.15 |
| Al | 0.696 | 0.688 | 0.695 |
| N | 0.002 | 0.002 | 0.001 |
| Ti | 0.002 | 0.002 | 0.002 |

All amounts reported in % by weight, balance to 100% by weight Fe and unavoidable impurities.

Hot-rolled strips are produced from these steels. The hot rolling temperature here is 845° C. After reeling-up of the hot-rolled strip at 625° C., cold rolling to a thickness of 2.06 mm is carried out. The values of $P_{1.0/50}$, $P_{1.5/50}$, $J_{2500/50}$, $P_{1.0/400}$, Rp0.2 and Rm are subsequently determined. The values are shown in table 2.

TABLE 2

| | | $P_{1.0/50}$ [W/kg] | A | $P_{1.5/50}$ [W/kg] | A | $J_{2500/50}$ [T] | A | $P_{1.0/400}$ [W/kg] | A | Rp0.2 [N/mm$^2$] | A | Rm [N/mm$^2$] | A |
|---|---|---|---|---|---|---|---|---|---|---|---|---|---|
| Sample 1 | finally heat treated | 2.01 | — | 4.09 | — | 1.58 | — | 23.44 | — | 531 | — | 606 | — |
| | reference heat treated at 800° C. | 1.09 | 1.84 | 2.51 | 1.62 | 1.57 | 1.01 | 15.94 | 1.47 | 435 | 1.22 | 560 | 1.08 |
| | reference heat treated at 850° C. | 0.85 | 2.36 | 2.16 | 1.89 | 1.56 | 1.01 | 15.00 | 1.56 | 414 | 1.28 | 543 | 1.12 |
| Sample 2 | finally heat treated | 1.95 | — | 4.07 | — | 1.57 | — | 22.78 | — | 531 | — | 605 | — |
| | reference heat treated at 790° C. | 1.01 | 1.93 | 2.48 | 1.64 | 1.56 | 1.01 | 16.34 | 1.39 | 441 | 1.20 | 576 | 1.05 |
| | reference heat treated at 850° C. | 0.84 | 2.32 | 2.21 | 1.84 | 1.55 | 1.01 | 15.67 | 1.45 | 413 | 1.29 | 545 | 1.11 |
| Sample 3 | finally heat treated | 1.40 | — | 3.00 | — | 1.58 | — | 19.29 | — | 454 | — | 582 | — |
| | reference heat treated at 770° C. | 1.21 | 1.15 | 2.74 | 1.09 | 1.57 | 1.01 | 17.76 | 1.08 | 456 | 1.00 | 584 | 1.00 |
| | reference heat treated at 850° C. | 0.94 | 1.48 | 2.30 | 1.30 | 1.56 | 1.01 | 15.93 | 1.21 | 429 | 1.06 | 559 | 1.04 |

A Ratio of the corresponding values for finally heat treated/reference heat treated The measured values reported were determined by the following methods:

Rp0.2:

The value Rp0.2 describes the yield point of the material and is determined in accordance with DIN EN ISO 6892-1: 2017-02 "Metallic materials—Tensile testing—Part 1: Method of test at room temperature".

Rm:

The value Rm describes the tensile strength of the material and is determined in accordance with DIN EN ISO 6892-1: 2017-02 "Metallic materials—Tensile testing—Part 1: Method of test at room temperature".

Polarization:

The polarization is determined in accordance with DIN EN 60404-2: 2009-01: "Magnetic materials—Part 2: Method of measurement of the magnetic properties of electrical steel strip and sheet by means of an Epstein frame".

Losses P:

The loss P is determined in accordance with DIN EN 60404-2: 2009-01: "Magnetic materials—Part 2: Method of measurement of the magnetic properties of electrical steel strip and sheet by means of an Epstein frame".

INDUSTRIAL APPLICABILITY

The non-grain-oriented electrical strip or sheet of the invention can preferably be used in electric motors, in particular for use in electric vehicles, or in generators.

The invention claimed is:

1. A non-grain-oriented electrical steel strip or sheet containing, apart from iron and unavoidable impurities, (figures in each case in % by weight)

up to 0.0040 of C,
from 0.0700 to 0.3000 of Mn,
from more than 2.700 to 3.250 of Si,
from 0.5500 to 0.8500 of Al,
up to 0.0400 of P,
up to 0.0035 of S,
up to 0.0070 of N and
up to 0.0070 of Ti, wherein a ratio of magnetic loss $P_{1.0/50}$ in a finally heat treated state to magnetic loss $P_{1.0/50}$ in a reference heat treated state is at least 1.10, wherein the reference heat treated state is a distinct heat treated state attained subsequent to the finally heat treated state and wherein the reference heat treated state is achieved at a temperature between 750° C. to 850° C. with a hold time of at least 20 minutes.

2. The non-grain-oriented electrical steel strip or sheet as claimed in claim 1, wherein the non-grain-oriented electrical steel strip or sheet has a thickness of from 0.26 to 0.38 mm.

3. The non-grain-oriented electrical steel strip or sheet as claimed in claim 1 wherein the reference heat treated state it has a grain size of from 50 to 130 μm.

4. The non-grain-oriented electrical steel strip or sheet as claimed in claim 3 wherein the reference heat treated state has a grain size of 70 to 100 μm.

5. The non-grain-oriented electrical steel strip or sheet as claimed in claim 1, wherein a ratio of magnetic loss $P_{1.5/50}$ in the finally heat treated state to magnetic loss $P_{1.5/50}$ in the reference heat treated state is at least 1.05.

6. The non-grain-oriented electrical steel strip or sheet as claimed in claim 1, wherein a ratio of magnetic loss $P_{1.0/400}$ in the finally heat treated state to magnetic loss $P_{1.0/400}$ in the reference heat treated state is at least 1.05.

7. The non-grain-oriented electrical steel strip or sheet as claimed in claim 1, wherein a ratio of polarization $J_{2500/50}$ in the finally heat treated state to polarization $J_{2500/50}$ in the reference heat treated state is at least 1.01.

8. The non-grain-oriented electrical steel strip or sheet as claimed in claim 1, wherein a yield point $Rp_{0.2}$ is from 400 to 580 N/mm$^2$.

9. The non-grain-oriented electrical steel strip or sheet as claimed in claim 1, wherein a tensile strength $R_m$ is from 500 to 680 N/mm$^2$.

10. A process for producing components comprising a non-grain-oriented electrical steel strip or sheet, comprising at least the following process steps:

(A) Provision of a hot-rolled strip containing, apart from iron and unavoidable impurities, (figures in each case in % by weight)

up to 0.0040 of C,
from 0.0700 to 0.3000 of Mn,
from more than 2.700 to 3.250 of Si,
from 0.5500 to 0.8500 of Al,
up to 0.0400 of P,
up to 0.0035 of S,
up to 0.0070 of N and
up to 0.0070 of Ti, (B) Cold rolling of the hot-rolled strip to give a non-grain-oriented electrical steel strip;

(C) Heat treatment of the cold-rolled strip from step (B) to give a non-grain-oriented electrical steel strip;

(D) Parting of components from the non-grain-oriented electrical steel strip which is obtained in step (C); and (E) Reference heat treatment of the components at a temperature of between 750° C. to 850° C. with a hold time of at least 20 minutes, wherein the reference heat treatment step (E) is a separate heat treatment than step (C) and conducted subsequent to step (D) wherein a ratio of magnetic loss $P_{1.0/50}$ in a finally heat treated state of step (C) to magnetic loss $P_{1.0/50}$ in a reference heat treated state is at least 1.10.

11. The process of claim 10, wherein the non-grain-oriented electrical steel strip has a thickness of from 0.26 to 0.38 mm.

12. The process of claim 10 wherein in the reference heat treated state it has a grain size of from 50 to 130 μm.

13. The process of claim 10, wherein a ratio of polarization $J_{2500/50}$ in the finally heat treated state to polarization $J_{2500/50}$ in the reference heat treated state is at least 1.01.

14. The process of claim 10, wherein a yield point $Rp_{0.2}$ is from 400 to 580 N/mm$^2$.

15. The process of claim 10, wherein a tensile strength $R_m$ is from 500 to 680 N/mm$^2$.

* * * * *